US009790074B2

(12) United States Patent
Clüsserath et al.

(10) Patent No.: US 9,790,074 B2
(45) Date of Patent: Oct. 17, 2017

(54) FILLING SYSTEM

(71) Applicant: KHS GmbH, Dortmund (DE)

(72) Inventors: Ludwig Clüsserath, Bad Kreuznach (DE); Dieter Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 146 days.

(21) Appl. No.: 14/770,199

(22) PCT Filed: Jan. 16, 2014

(86) PCT No.: PCT/EP2014/000108
§ 371 (c)(1),
(2) Date: Aug. 25, 2015

(87) PCT Pub. No.: WO2014/127879
PCT Pub. Date: Aug. 28, 2014

(65) Prior Publication Data

US 2016/0009534 A1 Jan. 14, 2016

(30) Foreign Application Priority Data

Feb. 25, 2013 (DE) ..... 10 2013 101 812
Feb. 25, 2013 (DE) ..... 10 2013 101 813

(51) Int. Cl.
*B67C 3/22* (2006.01)
*B67C 3/24* (2006.01)
*B67C 3/26* (2006.01)

(52) U.S. Cl.
CPC ..... *B67C 3/225* (2013.01); *B67C 3/244* (2013.01); *B67C 3/2634* (2013.01); *B67C 2003/228* (2013.01)

(58) Field of Classification Search
CPC ..... B65B 3/10; B67C 2003/228; B67C 2003/2651; B67C 2003/2668; B67C 3/225; B67C 3/244; B67C 3/2617; B67C 3/262; B67C 3/2634
USPC ..... 141/57, 148
See application file for complete search history.

(56) References Cited

U.S. PATENT DOCUMENTS

| | | | | |
|---|---|---|---|---|
| 9,302,895 | B2 * | 4/2016 | Clusserath | B67C 3/22 |
| 2005/0045244 | A1 | 3/2005 | Hartness et al. | |
| 2005/0284731 | A1 | 12/2005 | Hartness | |

FOREIGN PATENT DOCUMENTS

| | | |
|---|---|---|
| DE | 118 830 | 3/1901 |
| DE | 38 30 663 | 3/1990 |
| DE | 19545080 | 6/1997 |
| DE | 0 810 180 | 12/1997 |
| DE | 202005007446 | 12/2005 |

(Continued)

*Primary Examiner* — Timothy L Maust
*Assistant Examiner* — Andrew Schmid
(74) *Attorney, Agent, or Firm* — Occhiuti & Rohlicek LLP

(57) ABSTRACT

A filling system for filling bottles with liquid filling-material includes filling point pairs, each having filling points. Each filling point has a filling element and a container holder. Each filling element comprises a filling element housing, a liquid channel, a delivery opening that delivers liquid filling material to a bottle, a liquid valve that controls delivery through said delivery opening, a gas path control valve, and a lifter device for lifting and lowering said container holder. The lifter device includes a pneumatically operated actuating element. In operation, the actuating element connects to a bottle's interior

17 Claims, 8 Drawing Sheets

(56) References Cited

FOREIGN PATENT DOCUMENTS

| | | |
|---|---|---|
| DE | 102006017706 | 10/2007 |
| DE | 102008008945 | 8/2009 |
| DE | 102010032573 | 2/2012 |
| DE | 102011111483 | 2/2013 |
| EP | 1520833 | 4/2005 |
| GB | 2 036 703 | 7/1980 |

* cited by examiner

FILLING SYSTEM

RELATED APPLICATIONS

This application is the national stage under 35 USC 371 of PCT/EP2014/000108, filed on Jan. 16, 2014, which claims the benefit of the Feb. 25, 2013 priority dates of German applications 102013101813.0 and 102013101812.2 the contents of which are herein incorporated by reference.

FIELD OF INVENTION

The invention relates to container processing, and in particular, to filling containers with liquid.

BACKGROUND

It is known to have a filling system that has a plurality of filling points. Each filling point has a filling element and a container holder. The container-holder holds the container so that it is sealed against the filling element during filling. These systems implement many different filling methods, such as open jet filling, vacuum filling, and pressurized filling. It is also known to provide controlled gas paths in the filling elements or in their filling element housings In pressurized filling, a lifter device lifts the container holder so that it seals against the filling element. This lifting occurs during a filling phase in which the liquid filling material flows into the container. It also occurs in at least one process phase preceding this filling phase, for example when applying pressure to the container's interior.

SUMMARY

In one aspect, the invention features an apparatus for filling bottles with liquid filling-material. Such an apparatus includes a filling system having filling point pairs, each of which includes a first filling point, a second filling point, a control module, a second gas path, and a gas path control valve. Each of the first and second filling points includes a filling element and a container holder. Each filling element has a filling element housing, a liquid channel, a delivery opening, a liquid valve, a first gas path, and a lifter device. The delivery opening delivers the liquid filling-material into a container. The liquid valve controls the delivery of the liquid filling-material. The gas path control valve provides control over the second gas path. The second gas path at least in part provides control over the filling process. The lifter device is configured for lifting and lowering the container holder. The second gas path and the gas path control valve are configured in the control module. The control module is common to both filling elements. The first gas path is connected to the control module.

Some embodiments include a third gas path. In these embodiments, the lifter device includes a pneumatically operated actuating element connected by the third gas path to a container's interior.

In another aspect, the invention features an apparatus for processing bottles. Such an apparatus includes a filling system for filling bottles with liquid filling-material. The filling system includes filling point pairs, of which one is a first filling point pair that has first and second filling points. Each of the filling point includes a filling element and a container holder. Each filling element, in turn, includes a filling element housing, a liquid channel, a delivery opening, a liquid valve, a gas path control valve, a lifter device, and a pneumatically operated actuating element. The delivery opening delivers liquid filling material to a bottle in a manner controlled by the liquid valve. The gas path control valve, meanwhile, controls the filling process. The lifting device, which includes the pneumatically operated actuating element, lifts and lowers the container holder. In operation, the pneumatically operated actuating element is connected to a bottle's interior. In this embodiment, the container holder includes a common container holder and the lifter device that together lift containers for both filling points of the filling point pair.

Among these embodiments are those including a control module, an outer gas path configured in the control module, outside of the filling elements, and common to the two filling elements of the filling point pair, and an inner gas path internal to the filling points. The gas path control valve controls the outer gas path. Among these embodiments are those in which the control module serves more than one filling point pair, and those in which it servers no more than one filling point pair. Also among these embodiments are those in which the gas path control valve is a constituent of the control module, and those in which the pneumatically operated actuating element is a constituent of the control module.

Yet other embodiments include a first structure that is common to all filling point pairs of the filling system, and a second structure. The outer gas path is configured in the first structure, which is either a plate or a ring. The second structure is either the pneumatically operated actuating element or the lifter device.

Among these embodiments are those that have a third structure. In these embodiments, the first structure has an upper side attached to the third structure, and an underside that is attached to filling elements by top sides thereof, the top side being the side that faces away from the delivery opening of the filling element. The third structure is either the gas path control valve or the pneumatically operated actuating element.

Other embodiments include a container-gas path, and a linkage. In these embodiments, the filling point pair includes first and second pneumatically operated actuating elements, and first and second filling elements associated with corresponding ones of the pneumatically operated actuating elements. During a filling process, a bottle is sealed against the first filling element, and the container gas path connects an interior of the bottle to the first pneumatically operated actuating element. As a result, the pneumatically operated actuating elements are coupled to the container holder via the linkage.

Other embodiments include a container gas path, and a linkage. In these embodiments, the lifter device includes at most one pneumatically operated actuating element. During a filling operation, the container gas path connects an inner chamber of a container that is held sealed against the filling element with the at most one pneumatically operated actuating element. During the filling operation, the at most one pneumatically operated actuating element is charged with an internal pressure of the container, and wherein the linkage couples the at most one pneumatically operated actuating element to the common container holder.

Other embodiments include those in which the pneumatically operated actuating element includes a piston/cylinder arrangement, and those in which it includes a bellows.

In other embodiments, the filling system further includes a control module and a rotor element. The rotor element separates an aseptic space below the rotor element from an atmosphere above the rotor element. Each filling element, which is disposed on the rotor, includes an upper portion above the rotor and a lower portion below the rotor. In either case, both it and the gas path control valve are disposed above the rotor element.

In other embodiments, the filling system includes control modules, with each filling point pair being associated with a separate control module.

In yet other embodiments, the filling points comprise a first filling point pair having first and second filing elements, with the first filling point pair including a first inner gas path, a second inner gas path, an outer gas path, and a seal. The outer gas path is connected to the first and second inner gas path. The first inner gas path is associated with the first filling element and the second inner gas path is associated with the second element. The seal has an opening cross-section that is greater either one of the cross section of the inner or outer gas path in a region of the seal.

In yet other embodiments, a filling point pair is adjustable such that when the filling point pair is mounted to a first rotor having a first pitch circle having a first pitch circle radius, a distance between the filling elements is equal to a first value, and, when the filling point pair is mounted to a second rotor having a second pitch circle having a second pitch circle radius that is different from the first pitch circle radius, a distance between the filling elements is equal to the first value.

In yet another aspect, the invention includes a filling system for filling bottles with liquid filling-material. Such a filling system includes filling point pairs, each having filling points. Each filling point has a filling element and a container holder. Each filling element includes a filling element housing, a liquid channel, a delivery opening that delivers liquid filling material to a bottle, a liquid valve that controls delivery through the delivery opening, a gas path control valve, and a lifter device for lifting and lowering the container holder. The lifter device includes a pneumatically operated actuating element. In operation, the actuating element connects to a bottle's interior.

In the inventive filling system, the filling points do not just constitute filling point pairs having gas path control valves in gas paths bearing process gas and/or vacuum that (gas path control valves) are common to the filling elements of each filling point pair, and/or having pneumatic actuating elements for the container holders that are common to the filling elements of each filling point pair. The gas path control valve that is common to the two filling points of each filling point pair and/or the pneumatic actuating element that is common to the two filling points of each filling point pair also form part of a single control and/or actuating module or of a multiple control and/or actuating module that has an outer controlled gas path for each filling point pair and that is connected to an inner gas path configured in each filling element of the filling point pair concerned. These inner gas paths of the filling elements are not controlled, i.e. the filling elements themselves do not possess any gas path control valves.

This modular layout offers considerable benefits. For example, it can permit the necessary connection between the filling points and a ring channel that is common to all of the filling elements of a filling system to be operated on shortened gas paths. The ring channel is used, for example, to supply and/or evacuate process gases or a vacuum. The modular layout also allows the control and/or actuating modules, and in particular the gas path control valves and/or the actuating elements, to be arranged outside a hygienic or aseptic region or space in which the filling elements, with only a partial length having the delivery opening, and the container holders, are disposed.

In a preferred embodiment of the invention, the exterior gas paths are brought together into a ring that is disposed on the same axis as the vertical machine axis of a filling machine that forms the filling system. The filling elements are preferably attached to the underside of this ring by the tops of their filling element housings.

The modular layout also makes it possible to realize different filling element sizes or spacings between filling elements, i.e. a different number of filling point pairs on rotors, each with the same filling elements and the same gas path control valves and/or pneumatic actuating elements. Adjustment to the respective filling-element spacing is then effected solely by way of a ring arranged on the same axis as the machine axis of a filling machine that has the filling system and in which the outer gas paths are configured.

In any event however, the filling elements and the multiple control and/or actuating module or single control and/or actuating module are configured such that the connection between the inner and outer gas channels is also made at the same time as the mechanical attachment of the filling elements.

As used herein, "pressure-filling" is to be understood generally to mean a filling method in which the container to be filled lies in a sealed position against the filling element. Usually before the actual filling phase, i.e. before the liquid valve is opened, the filling element is pre-tensioned, through a controlled gas path configured in the filling element, with a pressurized pre-tensioning gas (inert gas or $CO_2$ gas) that the filling material entering the container during filling increasingly displaces as a return gas out of the container interior, again through a controlled gas path configured in the filling element. This pre-tensioning phase may be preceded by other treatment phases, for example by an evacuation and/or a purging of the container interior with an inert gas such as $CO_2$ etc., here again through the gas paths configured in the filling element.

As used herein, "open jet filling" refers to a method in which the liquid filling material flows to the container to be filled in an open filling jet, with the container not lying with its container mouth or container opening directly against the filling element but being spaced apart from the filling element or from the latter's filling material outlet. Another feature of this method is that the air displaced by the liquid filling material from the container during the filling process does not enter the filling element or a gas-bearing region or channel therein configured, but instead flows freely into the atmosphere.

As used herein, expressions such as "essentially," "in essence," or "around" mean variations from an exact value by ±10%, preferably by ±5% and/or variations that are insignificant for the function.

As used herein, a "control module" includes a control and/or actuation module that carries out control, actuation, or control and actuation.

Further embodiments, advantages, and possible applications of the invention arise out of the following description of embodiments and out of the figures. All of the described and/or pictorially represented attributes, whether alone or in any desired combination, are fundamentally the subject matter of the invention independently of their synopsis in the claims or a retroactive application thereof. The content of the claims is also made an integral part of the description.

BRIEF DESCRIPTION OF THE DRAWINGS

The invention is explained in detail below through the use of embodiment examples with reference to the figures. Figures.

DETAILED DESCRIPTION

Figure 1:
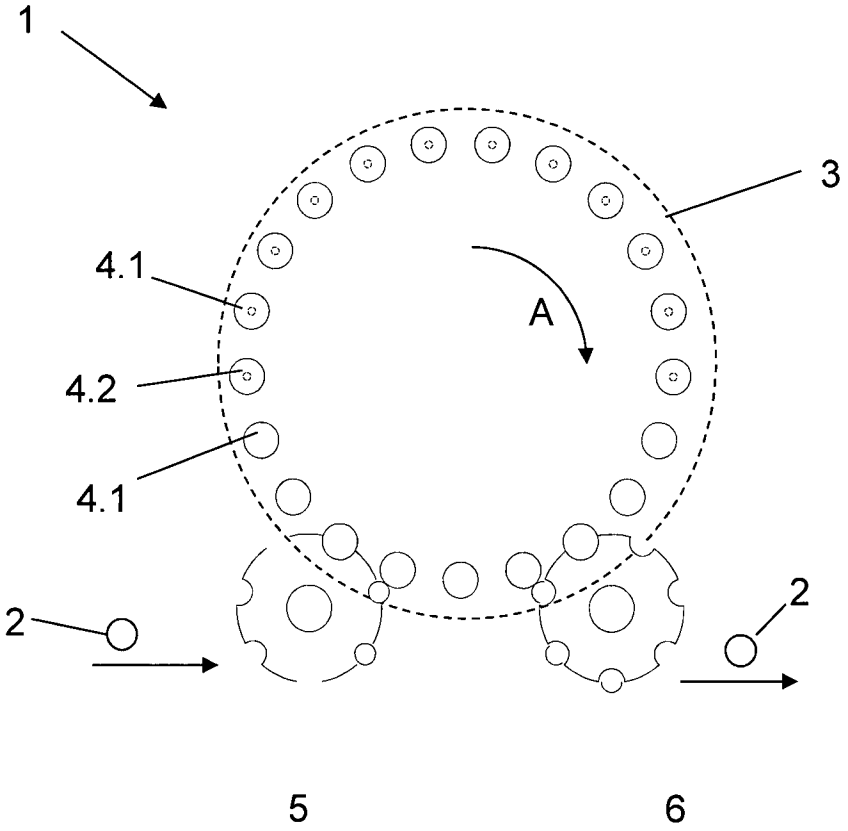
FIG. 1 shows a plan view of a rotary filling machine for filling containers with liquid filling material, such as beverages.

FIG. 1 shows a rotary filling machine 1 for filling bottles 2 with liquid filling material. The filling machine 1 comprises a rotor 3 that rotates about a vertical machine axis MA passing through its center. The rotor's pitch circle has first and second filling points 4.1, 4.2 disposed thereon. The center of the pitch circle is the machine axis MA. The distance between two adjacent filling points is a "pitch distance." In the illustrated embodiment, all pitch distances are the same.

The first and second filling points 4.1, 4.2 are formed in such a way that, in the direction of rotation A of the rotor 3, every second filling point 4.2 is adjacent to and between two first filling points 4.1. Empty bottles 2 arrive at the filling machine 1 through a container inlet 5 and leave as filled bottles 2 through a container outlet 6.

The filling points 4.1, 4.2 are configured for different filling methods. One method is pressurized filling of bottles 2. Pressurized bottle filling includes pre-tensioning a bottle's interior with a pressurized process gas or inert gas, such as $CO_2$ gas. It can also include purging the bottle's interior one or more times with a process gas or an inert gas. Pressurized bottle filling can also include evacuating the bottle's interior, rapid or slow filling of the bottle, and pressure-relief of the bottle's interior after filling. These process steps are controlled in part by gas path control valves in gas paths of the filling points 4.1, 4.2.

Figure 2:
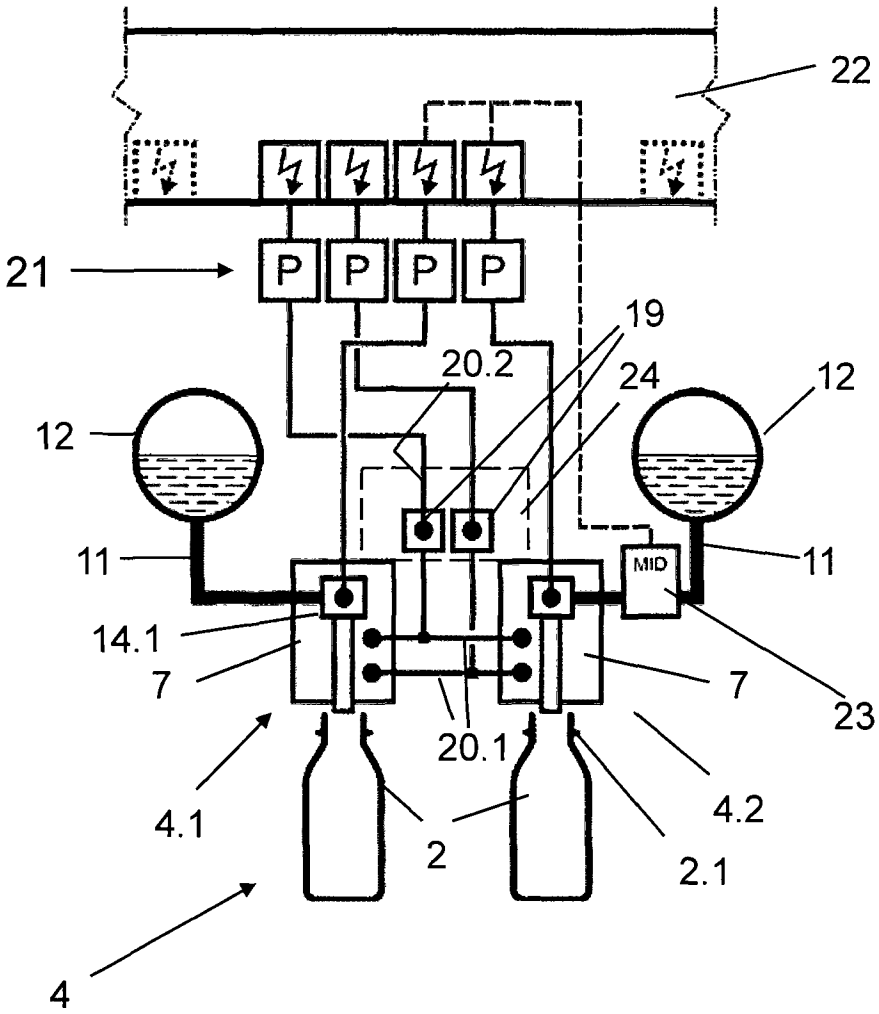
FIG. 2 shows a pair of filling points of the filling machine of FIG. 1.
Figure 4:
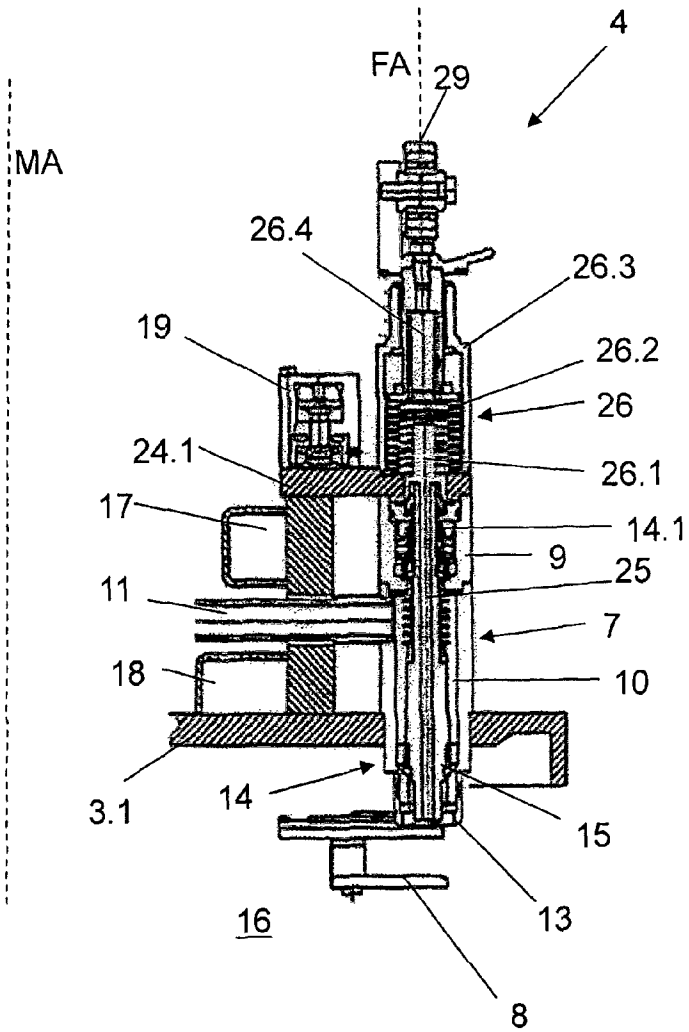
FIG. 4 shows a section through a rotor element as well as one of the filling elements of the filling point pair shown in FIG. 3.
Figure 3:
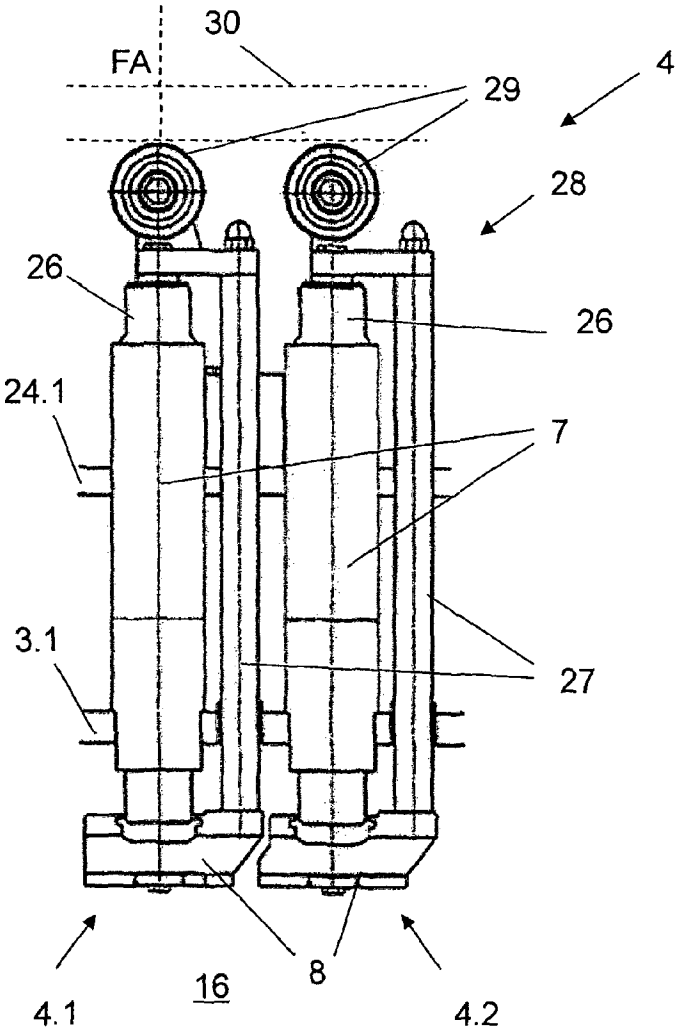
FIG. 3 shows two filling elements of the filling point pair shown in FIG. 2 in side view and looking radially toward a vertical machine axis.

As indicated in FIGS. 2 to 4, each filling point 4.1, 4.2 has a filling element 7 and a container holder 8. The container holder 8 suspends a bottle 2 by its mouth flange 2.1. During filling, a bottle 2 lies with its mouth sealed against the underside of filling element 7. FIG. 2 shows first and second filling points 4.1, 4.2 forming a first filling point pair 4 having two filling elements 7 and associated container holders 8, best seen in FIG. 3.

Referring to FIG. 4, a filling element 7 has a filling element housing 9 in which is configured a liquid channel 10. A product line 11 discharges into the top of the liquid channel 10. The product line 11 extends from a filling material tank 12 on the rotor 3, as shown in FIG. 2. The filling material tank 12 is common to all the filling points 4.1, 4.2. During the filling process, filling material partly fills the filling material tank 12.

Referring again to FIG. 3, on the underside of the housing 9, the liquid channel 10 forms an annular delivery opening 13 for discharging the liquid filling material. Within the liquid channel's interior is a liquid valve 14 having a valve body 15. The valve body 15 moves axially along a vertical filling element axis FA to open and close the valve 14, thereby controlling delivery of liquid filling material through the delivery opening 13 and into a bottle 2. In some embodiments, a pneumatic actuating device 14.1 moves the valve body 15.

The rotor 3 includes an upper disc-like rotor element 3.1. Ring channels 17, 18 at the top of rotor element 3.1 feed gas or provide a vacuum for all filling elements 7.

The upper disc-like rotor element 3.1 also forms a top seal for an aseptic space 16. Wall elements, which are not shown, form the sides and base of the aseptic space 16, thus completing the separation of the aseptic space 16 from the atmosphere.

The filling elements 7 are mounted in openings around the periphery of the rotor element 3.1 in such a way that a lower section of the filling element 7 protrudes into the aseptic space 16. This lower section includes an associated container holder 8. An upper region of the bottle forms the bottle's opening. This region moves through the aseptic space 16 during filling.

Referring now to FIG. 2, each first filling point pair 4 has an associated pair of jointly controlled gas path control valves 19. The gas path control valves 19 permit control over various phases of the filling process. These gas path control valves 19 are common to both filling elements 7 of the first filling point pair 4.

FIG. 2 shows two sets of gas paths: inner gas paths 20.1 and outer gas paths 20.2.

The inner gas paths 20.1 do not have any control valves. These inner gas paths 20.1 are therefore uncontrolled. Within a filling element 7 or within a housing 9, only these uncontrolled inner gas paths 20.1 are present.

The inner gas paths 20.1 of the two filling elements 7 of each first filling point pair 4 open out into the outer gas paths 20.2. As a result, the gas path control valve 19 controls both filling elements 7 of a first filling point pair 4 simultaneously.

In some embodiments, the gas path control valves 19 are pneumatically operable valves that are actuated by a valve block 21 having electrically controlled actuators. A machine controller 22 controls these actuators. The valve block 21 also controls the liquid valves 14 that open and close the filling elements 7.

Control over the various valves depends at least in part on the how much filling material flows into bottles 2 during the filling phase. A flow meter 23 measures this quantity and transmits pertinent data to the machine controller 22. In some embodiments, the flow meter 23 is a magnetic induction flow meter, As long as they are accurately configured, the filling elements 7 will have the same filling rate. It is therefore possible to use only one flow meter 23 for each first filling point pair 4. This flow meter 23 is placed in a product line 11 that connects the tank 12 to either one of the two filling elements 7.

The double-valve control system described herein offers synchronous valve activation under virtually identical process conditions. For example, for each pair of filling elements 7, the filling pressure, the fill level in the product tank 12, and the temperature will be the same or very close to the same. This means it is possible to use only one flow meter 23 to provide one measurement signal for two filling points 4.1, 4.2. Additionally, there is only one control signal per first filling point pair 4.

Previous attempts to provide one flow meter 23 for two filling points 4.1, 4.2 have failed because of unpredictable short-term changes in the process parameters. These changes have different effects on the respective filling points 4.1, 4.2, the results of which are significant differences in the filling characteristics of even immediately adjacent valves. As a result, known filling machines have a separate a flow meter 23 at each filling point 4.1, 4.2.

In the illustrated embodiment, the gas path control valves 19 and the outer gas paths 20.2 of all first filling point pairs 4 are part of a multiple control-module 24. The multiple-control module 24 has separate gas path control valves 19 and outer gas paths 20.2 for each first filling point pair 4. Each filling element 7 is connected to one of these gas path control valves 19.

In an alternative embodiment, instead of a multiple-control module 24, a single control-module controls the filling points. Like the multiple-control module, the single-control module has gas path control valves 19 and outer gas paths 20.2 that can be used for the first filling point pairs 4.

The architecture described above results in a modular layout and design. This modularity arises whether the filling elements 7 are used with the multiple-control modules 24 or with single-control modules. This modular layout simplifies the replacement of faulty components, such as a faulty filling element 7, a faulty multiple-control module 24, or a faulty single-control module. The modular configuration also makes it possible to fit specially constructed filling elements 7 with either a standard multiple-control module 24, a standard single-control module, a non-standard multiple-control module 24, or a non-standard single-control module with standard filling elements 7. This simplifies conversion of the filling machine 1 for special filling processes.

Referring now to FIGS. 3 and 4, a ring 24.1 that is common to all multiple-control modules 24 concentrically surrounds the vertical machine axis MA. This ring 24.1 is located outside the aseptic space 16 and above the rotor element 3.1. The ring 24.1 has an edge region that is radially outside relative to the machine axis MA. This edge region is part of the filling element housing 9. In some embodiments, the edge region of the ring 24.1 forms at least part of an upper termination of a filling element housing 9.

The outer gas channels 20.2 are provided on this ring 24.1. In addition, the gas path control valves 19 are arranged on top of the ring 24.1. These gas path control valves 19 are offset radially inwards relative to the vertical machine axis MA opposite the filling element housing 9 associated with the control valve 19.

In operation, a bottle 2 is lifted up and pressed against the filling element 7 to form a seal around the delivery opening 13. This requires application of a force. The source of at least part of this force is none other than the internal pressure present in the bottle 2 itself during the filling process.

A gas channel 25 in the filling element 7 communicates pressure between the bottle's interior and a pneumatic actuation element 26 disposed on top of the ring 24.1. Each pneumatic actuation element 26 is part of the multiple-control module 24.

An actuating element 26 includes a bellows 26.2, a housing 26.3, and a cam follower 26.4. The bellows 26.2 forms a pressure chamber 26.1. The housing 26.3 surrounds the bellows 26.2. The cam follower 26.4 is axially guided within the housing 26.3.

During the filling process, a lower opening connects the gas channel 25 with the bottle's interior and discharges above into the pressure chamber 26.1 of the pneumatic actuating element 26.

Referring to FIG. 3, the pneumatic actuating element 26 connects to a lifter rod 27 that runs parallel to the filling element axis FA and that has a container holder 8 at its lower end. In the illustrated embodiment, the gas channel 25 is at least in part configured on a tubular valve stem that has the valve body 15 of the liquid valve 14. The pneumatic actuating element 26 thus harnesses the internal pressure in the bottle 2 and transmits it to the lifter rod 27 so that it can be used to lift the bottle 2 and to press it against the filling element 7.

In some embodiments, the actuating element 26 also has a spring that pre-tensions the container holder 8 in its upper lifting position. The actuating element 26 and the lifter rod 27 form part of a lifter device 28, shown in FIG. 3. At the top of the filling element 7, each lifter device 28 has a cam roller 29 that interacts with a cam 30. This cam 30 does not rotate with the rotor 3. The interaction of the cam 30 with the cam roller 29 lowers the container holders 8 even against the lifting force of actuating element 26 where this is necessary as part of the filling process, for example at the end of the filling process.

Figure 6:
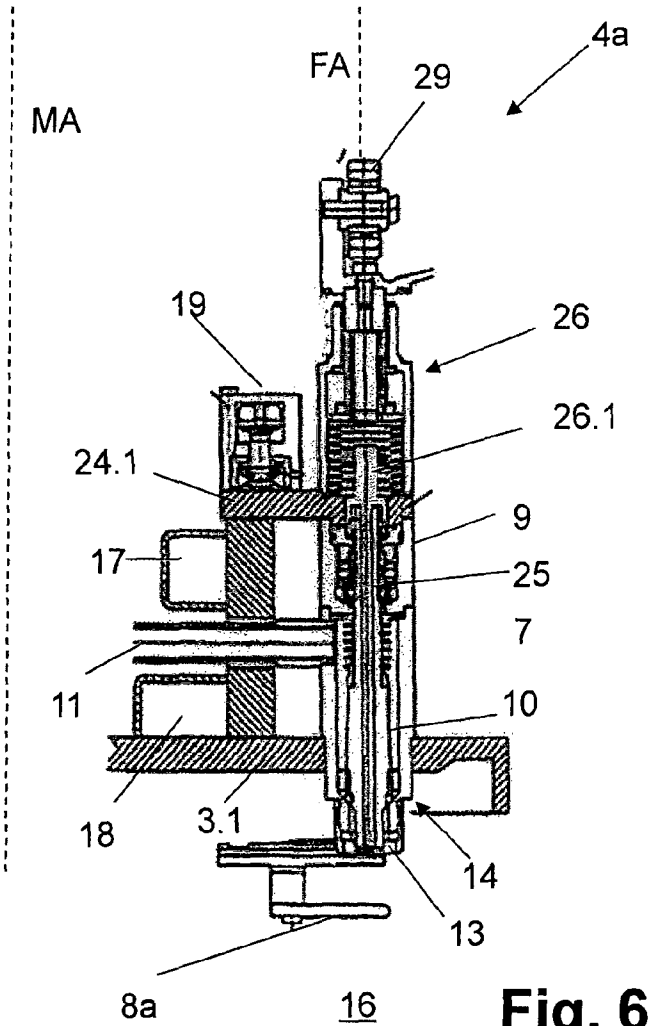
FIGS. 5 and 6 show representations like FIGS. 3 and 4 of a second embodiment of a filling point pair.
Figure 5:
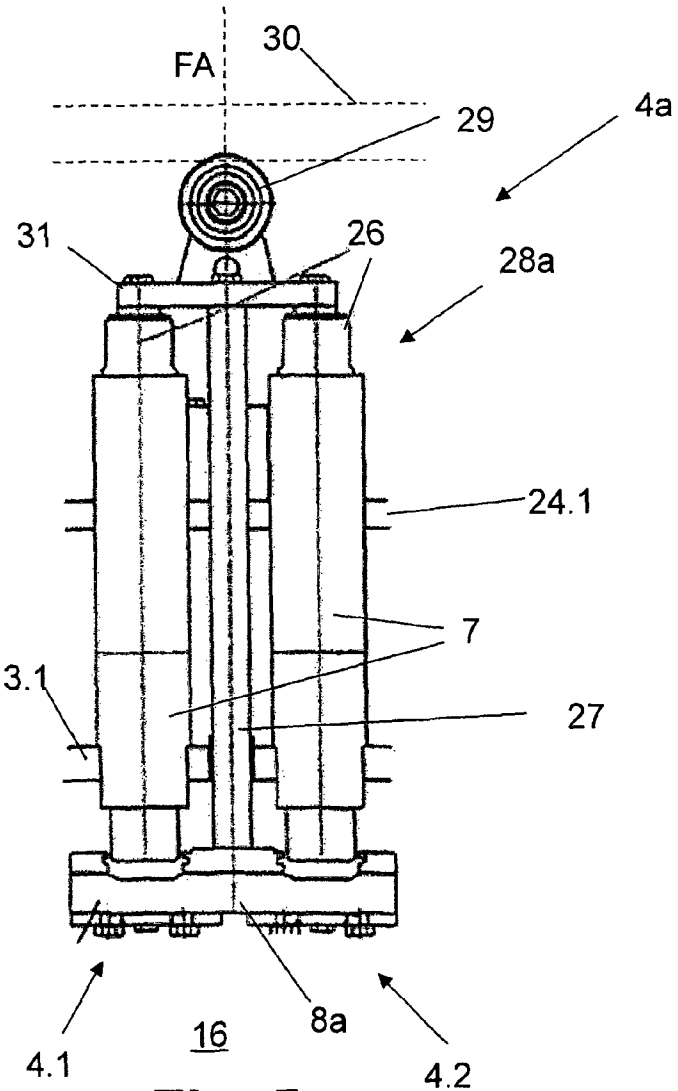

FIGS. 5 and 6 show a second filling point pair 4*a* in which the container holder 8*a* is common to both filling elements 7. In this embodiment, the container holder 8 suspends two bottles 2 by their mouth flanges 2.1 during filling.

In the embodiment shown in FIGS. 5 and 6, a pair of pneumatic actuating elements 26 forms a lifter device 28*a* that lifts both bottles at once. The actuating elements 26 connect to ends of a cross member 31. A common lifter rod 27 attaches by its upper end to the center of the cross member 31 between the filling elements 7. The pneumatic actuating elements 26 are configured as bellows as described in connection with FIGS. 3 and 4. The lower end of the lifter rod 27 connects to the center of the container holder 8*a*. The cam roller 29 is mounted at the center of the cross member 31 where it freely rotates.

Aside from the foregoing differences, the second filling point pair 4*a* shown in FIGS. 5 and 6 is the same as the first filling point pair 4 shown in FIGS. 3 and 4.

Figure 8:
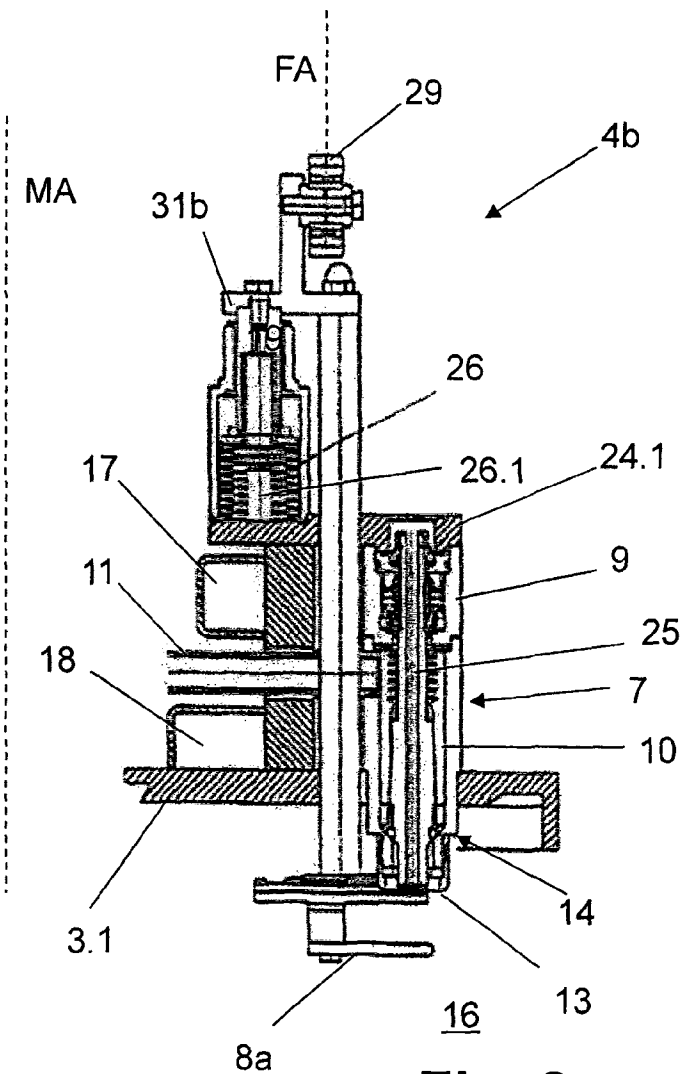
FIGS. 7 and 8 show representations like FIGS. 3 and 4 of a third embodiment of a filling point pair.
Figure 7:
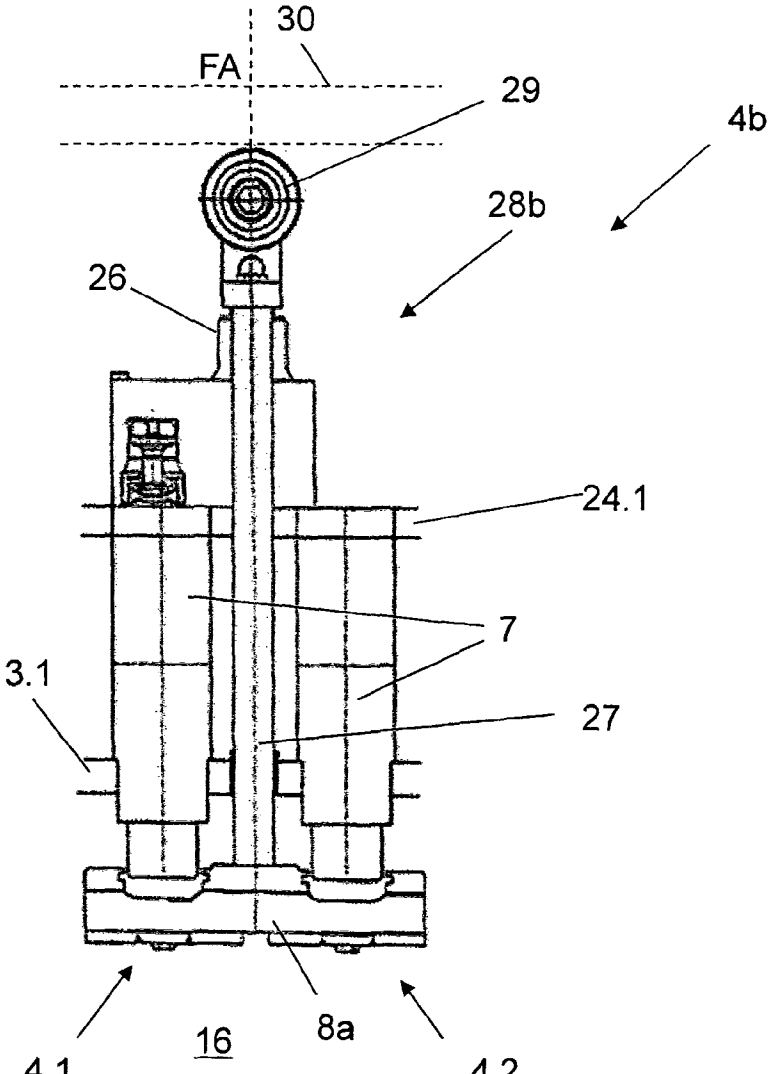

In an alternative embodiment, shown in FIGS. 7 and 8, a third filling point pair 4*b* has a lifter device 28*b* that has only one actuating element 26 for both filling points 4.1, 4.2. Like the gas path control valves 19, the actuating element 26 is provided on the top of ring 24.1. Internal pressure from a bottle charges the pressure chamber 26.1 of the sole actuating element 26 during the filling process through an outer gas channel 20.2.

The lifter rod 27 and the actuating element 26 for the container holder 8*a* are offset radially inwards from filling elements 7, in such a manner that the radial distance of the actuating element 26 from the machine axis MA is somewhat less than the corresponding radial distance of the lifter rod 27 whose upper end is connected by a cross member 31*b* with the actuating element 26 or with its cam follower. Once again, a cam roller 29 mounted at the center of the cross member 31*b* freely rotates.

Among the features that the first, second, and third filling point pairs 4, 4*a*, 4*b* have in common is a multiple-control module 24 that has gas path control valves 19 with controlled outer gas paths 20.2, while the filling elements 7 themselves have only uncontrolled inner gas paths 20.1. The embodiments also have in common the fact that the multiple-control module 24 defines a modular architecture that includes a ring 24.1, gas path control valves 19 and actuating elements 26.

The embodiments illustrated in FIGS. 3 to 8 also have in common the fact that, for the two filling points 4.1, 4.2 of each of the second and third filling point pair 4*a*, 4*b*, a common container holder 8*a* and a common lifter device 28*a*, 28*b* are provided for the filling elements 7. It is a further particularity of the third filling point pair 4*b* of FIGS. 7 and 8 that the lifter device 28*b* for common container holder 8*a* has only a single pneumatic actuating element 26 that is provided on ring 24.1 and charged with pressure through a local outer gas path 20.2.

Figure 9:
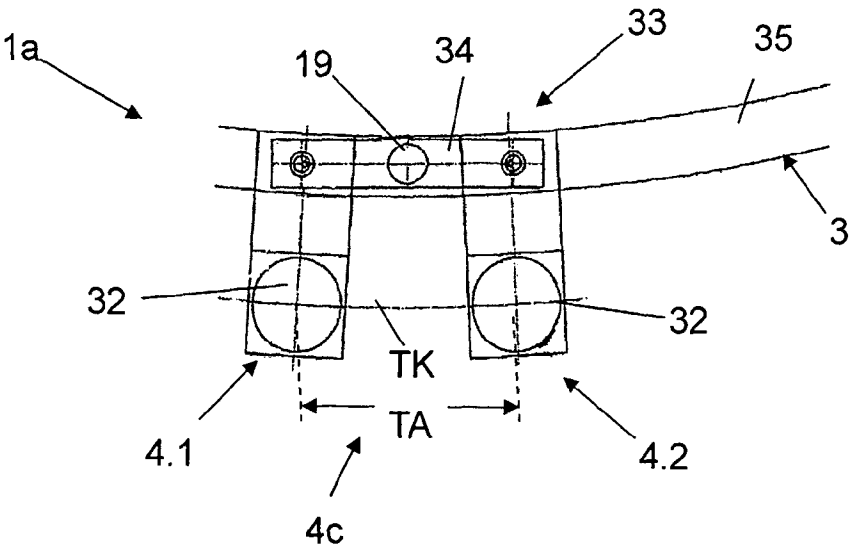
FIGS. 9 and 10 each show a simplified schematic representation in plan view and side view respectively of a fourth embodiment of a filling point pair.
Figure 10:
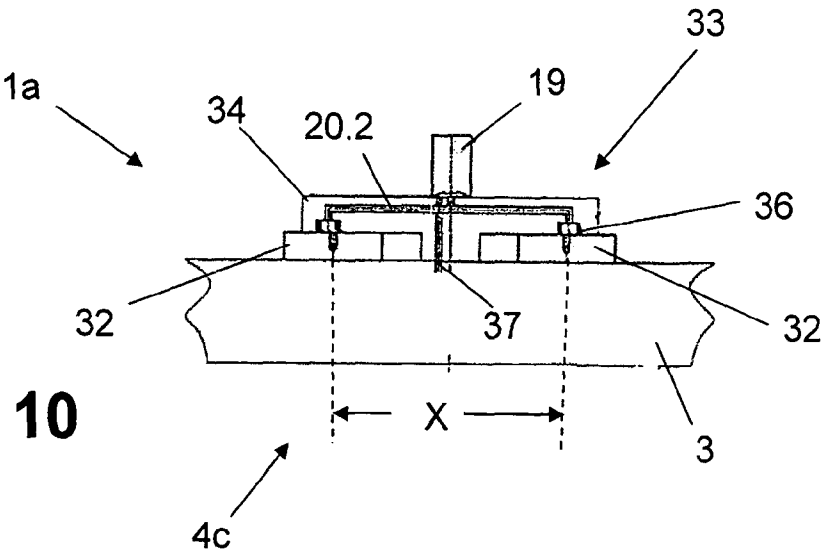

FIG. 9 shows a plan view of a fourth filling point pair 4*c* on a rotor of a filling machine 1*a*. FIG. 10 shows a side view of the same fourth filing point pair 4*c*.

The fourth filling point pair 4*c* includes two filling points 4.1, 4.2, each of which has an associated filling element 32. A common control module 33 controls the gas paths. However, instead of being formed by a ring common to all filling point pairs, the illustrated common control module 33 is formed by a discrete module body 34 for each filling point pair 4*c*.

In the illustrated embodiment, the discrete module body 34 is a plate that has an outer gas path 20.2 that contains the gas path control valve 19. The gas path control valve 19 controls a connection between the outer gas path 20.2 and an annular gas channel 35, best seen in FIG. 9, that is configured on the rotor 3, and that is common to all filling points 4.1, 4.2. The common control module 33 is offset radially inwards from the filling elements 32, so that it lies between the filling elements 32 and the machine axis MA.

Figure 13:
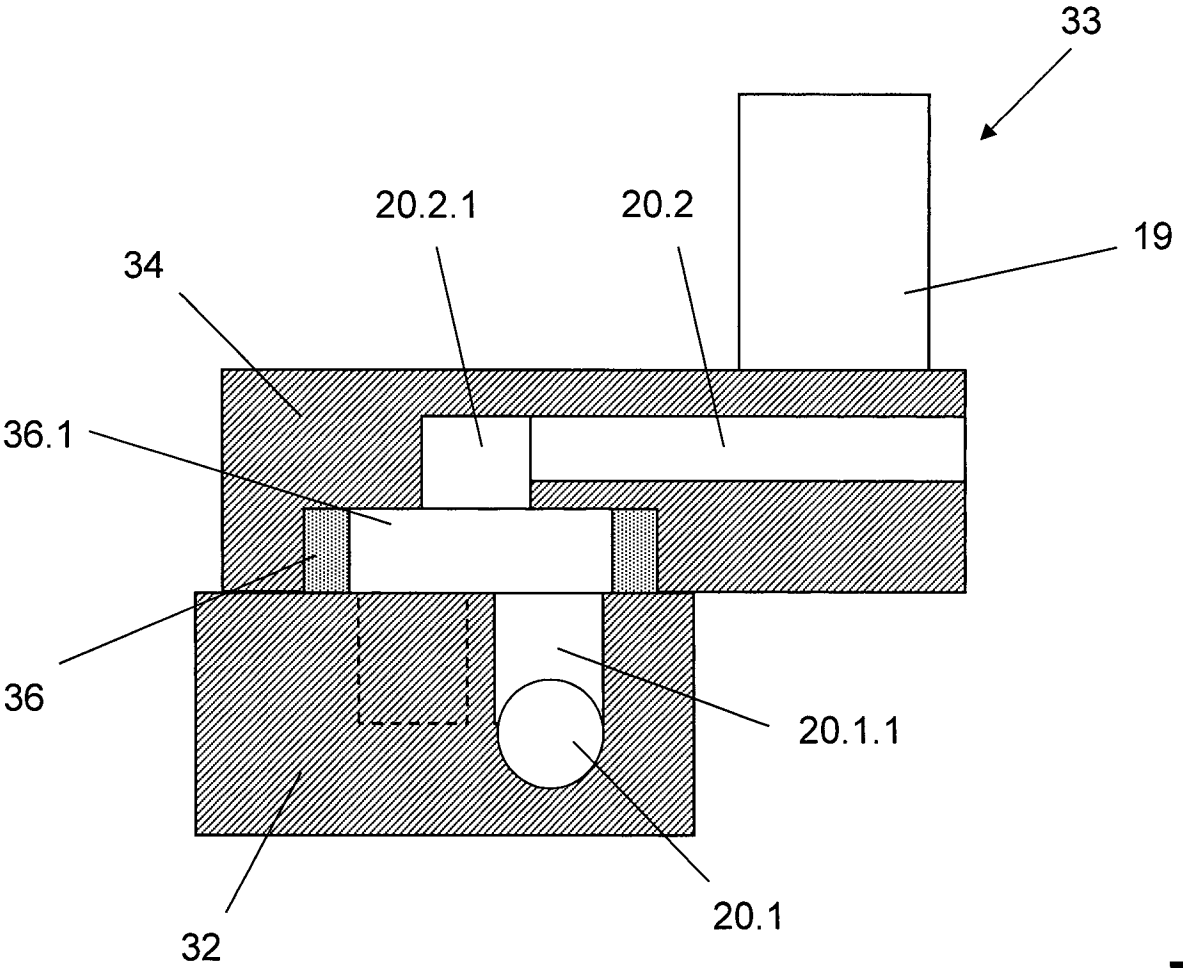
FIG. 13 shows an interface between the inner and outer gas channels in the filling point pair of FIGS. 9 and 10.

First and second union openings 20.2.1, 20.2.2 effect a connection between outer gas paths 20.2 and the associated inner gas path 20.1 in the housings of the filling elements 32 shown in FIGS. 9 and 10, as seen in FIG. 13. The first union openings 20.2.1 are openings in the outer gas paths 20.2. The second union openings 20.1.1 are openings in the inner gas paths 20.1.

In each case, a filling element 32 and the discrete module body 34 lie against each other on a flat surface that is oriented preferably square to the vertical machine axis. A seal 36 provides a sealed transition between the outer gas path 20.2 and the associated inner gas path 20.1. The opening cross-section of the seal 36 is greater than the cross-section of either the first union opening 20.2.1 or the second union opening 20.1.1. The common control module 33, or its discrete module body 34, also has a union opening 37 for connection to the annular gas channel 35.

Figure 11:
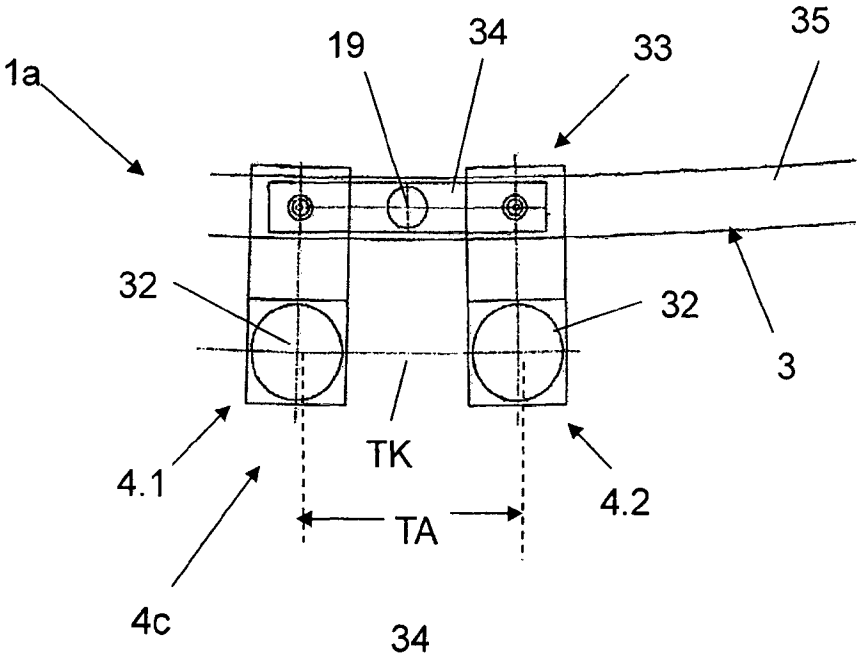
FIGS. 11 and 12 show the filling point pair shown in FIGS. 9 and 10 but adjusted to fit a different pitch circle.
Figure 12:
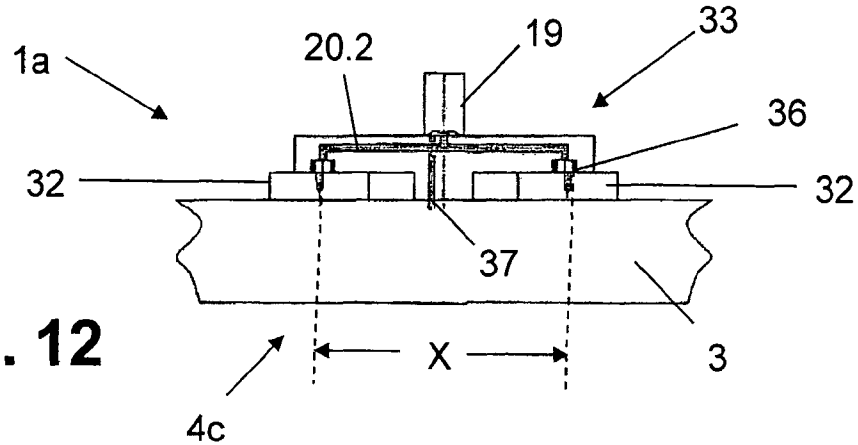

An advantage of the modular structure of the fourth filling point pairs 4*c* is that filling point pairs 4*c* with the same pitch distance TA between filling elements 32 can be adapted for use on filling machines with different rotor diameters and with different pitch circle radii. This is illustrated by comparing FIGS. 9 and 10, which show the arrangement of filling elements 32 on a small radius pitch circle TK, with FIGS. 11 and 12, which show the arrangement of filling elements 30 on a larger dia radius meter pitch circle TK.

A center-to-center distance X between union openings 20.1.1 varies because of different pitch circle sizes. However, this variation can be compensated for because the seal opening 36.1 is significantly larger than the cross-section of at least the first union openings 20.1.1, as shown in FIG. 13. It is consequently possible to compensate for variations in center-to-center distance X up to an amount equal to the difference in the cross-sectional sizes of the seal opening 36.1 and the first union openings 20.1.1.

Different pitch distances TA of filling points 4.1, 4.2, i.e. center-to-center distances of filling elements 32 that form these filling points 4.1, 4.2 around the periphery of rotor 3, will then require common control modules 33 in which the center-to-center distance of union openings 20.2.1 is adjusted to match the respective pitch distance.

The invention has been described hereinbefore by reference to embodiments. It goes without saying that numerous variations as well as modifications are possible without departing from the inventive concept underlying the invention.

Having described the invention, and a preferred embodiment thereof, what is claimed as new, and secured by letters patent is:

1. An apparatus for filling bottles with liquid filling-material, said apparatus comprising a filling system having a plurality of filling point pairs, each of which comprises a first tilling point, a second filling point, a control module, a second gas path, a third gas path, and a gas path control valve, wherein each of said first and second filling points comprises a filling element and a container holder, wherein each filling element comprise a filling element housing, a liquid channel, a delivery opening, a liquid valve, a first gas path, and a lifter device, wherein said delivery opening delivers said liquid filling-material into a container, wherein said liquid valve controls said delivery of said liquid filling-material, wherein said gas path control valve provides control over said second gas path, wherein said second gas path at least in part provides control over said filling process, wherein said lifter device is configured for lifting and lowering said container holder, wherein said second gas path and said gas path control valve are configured in said control module, wherein said control module is common to both filling elements, and wherein said first gas path is connected to said control module, and wherein said lifter device comprises a pneumatically operated actuating element, wherein said third gas path connects said pneumatically operated actuating element to a container's interior.

2. An apparatus for processing bottles, said apparatus comprising a filling system for filling bottles with liquid filling-material, wherein said filling system comprises filling point pairs, wherein said filling point pairs comprise a first filling point pair, wherein said first filling point pair comprises first and second filling points, wherein each of said filling point comprises a tilling element and a container bolder, wherein each filling element comprises a filling element housing, a liquid channel, a delivery opening, a liquid valve, a gas path control valve, a lifter device, and a pneumatically operated actuating element, wherein, said delivery opening delivers liquid filling material to a bottle, wherein said liquid valve controls delivery through said delivery opening, wherein said gas path control valve is configured to control a filling process, wherein said lifter device is configured for lifting and towering said container holder, wherein said lifter device comprises said pneumatically operated actuating element, wherein, in operation, said pneumatically operated actuating element is connected to a bottle's interior, wherein said container holder comprises a common container holder and said lifter device, and wherein said common container holder lifts containers for both filling points of said filling point pair.

3. The filling system of claim 2, further comprising a control module, an outer gas path, and an inner gas path, wherein said outer gas path is configured in said control module and outside of said tilling elements, wherein said outer gas path is common to two filling elements of said filling point pair, wherein said gas path control valve controls said outer gas path, and wherein said inner gas path is internal to said filling points.

4. The apparatus of claim 3, wherein said control module serves more than one filling point pair.

5. The apparatus of claim 3, wherein said control module serves no more than one filling point pair.

6. The apparatus of claim 3, wherein said gas path control valve is a constituent of said control module.

7. The apparatus of claim 3, wherein said pneumatically operated actuating element is a constituent of said control module.

8. The apparatus of claim 3, further comprising a first structure and a second structure, wherein said first structure is common to all tilling point pairs of said filling system, wherein said first structure comprises a surface side, wherein said second structure is provided on said surface side wherein said outer gas path is configured in said first structure, wherein said first structure is selected from the group consisting, of a plate and a ring, and wherein said second structure is selected from the group consisting of said pneumatically operated actuating element and said lifter device.

9. The apparatus of claim 8, further comprising a third structure, wherein said first structure comprises an upper side, wherein said first structure comprises an underside, wherein said third structure is attached to said upper side, wherein said filling element housings each comprise a top side that faces away from said delivery opening thereof, wherein said filling elements are attached to said underside by said top sides, and wherein said third structure is selected from the group consisting of said gas path control valve and said pneumatically operated actuating element.

10. The apparatus of claim 2, further comprising a container-gas path, and a linkage, wherein said filling point pair comprises a first pneumatically operated actuating element, a second pneumatically operated actuating element, a first filling element, and a second filling element, wherein said first pneumatically operated actuating element is associated with said first filling element and said second pneumatically operated actuating element is associated with said second filling element, wherein, during a filling process, a bottle is sealed against said first filling element, wherein, during said filling process, said container gas path connects an interior of said bottle to said first pneumatically operated actuating element, and wherein said first and second pneumatically operated actuating elements are coupled to said container holder via said linkage.

11. The apparatus of claim 2, further comprising a container gas path, and a linkage, wherein said lifter device comprises at most one pneumatically operated actuating element, wherein, during a tilling operation, said container gas path connects an inner chamber of a container that is held sealed against said filling element with said at most one pneumatically operated actuating element, wherein, during said tilling operation, said at most one pneumatically operated actuating element is charged with an internal pressure of said container, and wherein said linkage couples said at most one pneumatically operated actuating element to said common container holder.

12. The apparatus of claim 2, wherein said pneumatically operated actuating element comprises a piston/cylinder arrangement.

13. The apparatus of claim 2, wherein said pneumatically operated actuating element comprises a bellows.

14. The apparatus of claim 2, wherein said filling system further comprises a control module and a rotor element, wherein said rotor element separates an aseptic space below said rotor element from an atmosphere above said rotor element, wherein each filling element comprises an upper portion and a lower portion, wherein each tilling element is disposed on said rotor element, wherein said upper portion extends above said rotor element, wherein said lower portion extends below said rotor element, where said delivery opening is disposed in said lower portion, and a control module, wherein said control module is disposed above said rotor element, and wherein said gas path control valve is disposed above said rotor element.

15. The apparatus of claim 2, wherein said filling system comprises control modules, and wherein each filling point pair is associated with a separate control module.

16. The apparatus of claim 2, wherein said filling points comprise a first filling point pair having first and second filing elements, wherein said first filling point pair comprises a first inner gas path, a second inner gas path, an outer gas path, and a seal, wherein said outer gas path is connected to said first and second inner gas paths, wherein said first inner gas path is associated with said first filling, element, wherein said second inner gas path is associated with said second element, wherein said seal has an opening cross-section that is greater than a first value, and wherein said first value is selected from the group consisting of a cross section of said outer gas path in a region of said seal and an associated inner gas path in a region of said seal.

17. The apparatus of claim 2, wherein a filling point pair is adjustable such that, when said filling point pair is mounted to a first rotor having a first pitch circle having a first pitch circle radius, a distance between said filling elements is equal to a first value, and, when said filling point pair is mounted to a second rotor having a second pitch circle having a second pitch circle radius that is different from said first pitch circle radius, a distance between said filling elements is equal to said first value.

* * * * *